US007174764B2

(12) United States Patent
Oosterling et al.

(10) Patent No.: US 7,174,764 B2
(45) Date of Patent: Feb. 13, 2007

(54) APPARATUS FOR AND A METHOD OF EXPANDING TUBULARS

(75) Inventors: Peter Oosterling, Berkel en Roderijs (NL); Colin Neil Morrison, Houston, TX (US); Philip Michael Burge, Aberdeenshire (GB)

(73) Assignee: E2 Tech Limited, The Hauge (NL)

( * ) Notice: Subject to any disclaimer, the term of this patent is extended or adjusted under 35 U.S.C. 154(b) by 18 days.

(21) Appl. No.: 10/485,995

(22) PCT Filed: Aug. 12, 2002

(86) PCT No.: PCT/GB02/03734

§ 371 (c)(1),
(2), (4) Date: Feb. 1, 2005

(87) PCT Pub. No.: WO03/015954

PCT Pub. Date: Feb. 27, 2003

(65) Prior Publication Data

US 2005/0126251 A1 Jun. 16, 2005

(30) Foreign Application Priority Data

Aug. 16, 2001 (GB) ..... 0119977.7

(51) Int. Cl.
*B21D 31/04* (2006.01)
*E21B 43/10* (2006.01)

(52) U.S. Cl. ..... 72/370.06; 72/125; 166/207

(58) Field of Classification Search ..... 72/122, 72/370.06, 370.08, 125; 166/206, 217, 384, 166/207

See application file for complete search history.

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | |
| 2,096,234 | A | 10/1937 | Erwin | 153/81 |
| 2,383,214 | A | 8/1945 | Prout | |
| 2,499,630 | A | 3/1950 | Clark | |
| 2,627,891 | A | 2/1953 | Clark | |
| 2,663,073 | A | 12/1953 | Bieber et al. | |

(Continued)

FOREIGN PATENT DOCUMENTS

| | | |
|---|---|---|
| EP | 0 961 007 | 12/1999 |

(Continued)

*Primary Examiner*—Lowell A. Larson
(74) *Attorney, Agent, or Firm*—Patterson & Sheridan, LLP

(57) ABSTRACT

Apparatus for and a method of expanding tubulars, and particularly tubulars or a string of tubulars that have one or more per orated portions and one or more non-perforated portions. In one embodiment, the apparatus (150) includes an inflatable element (e.g. a packer 152) that has a shaft (156) rotatably coupled thereto so that the shaft (156) can rotate relative to the inflatable element (152). An expansion cone (158) is threadedly engaged with a threaded portion (**156*t*) of the shaft (156) so that it moves along the threaded portion (156*t*) upon rotation of the shaft (156) relative to the cone (158**).

37 Claims, 4 Drawing Sheets

U.S. PATENT DOCUMENTS

| | | | | |
|---|---|---|---|---|
| 2,754,577 | A | 7/1956 | Maxwell | |
| 2,898,971 | A | 8/1959 | Hempel | |
| 3,087,546 | A | 4/1963 | Woolley | |
| 3,179,168 | A * | 4/1965 | Vincent | 166/277 |
| 3,195,646 | A | 7/1965 | Brown | |
| 3,208,531 | A | 9/1965 | Tamplen | |
| 3,467,180 | A | 9/1969 | Pensotti | |
| 3,776,307 | A | 12/1973 | Young | |
| 3,785,193 | A | 1/1974 | Kinley et al. | |
| 3,818,734 | A | 6/1974 | Bateman | |
| 3,885,298 | A | 5/1975 | Pogonowski | |
| 3,911,707 | A | 10/1975 | Minakov et al. | |
| 3,948,321 | A | 4/1976 | Owen et al. | |
| 3,986,383 | A | 10/1976 | Petteys | 72/393 |
| 4,069,573 | A | 1/1978 | Rogers, Jr. et al. | |
| 4,090,382 | A | 5/1978 | Schott | |
| 4,099,400 | A | 7/1978 | Schott | |
| 4,127,168 | A | 11/1978 | Hanson et al. | |
| 4,159,564 | A | 7/1979 | Cooper, Jr. | |
| 4,288,082 | A | 9/1981 | Setterberg, Jr. | |
| 4,324,407 | A | 4/1982 | Upham et al. | |
| 4,371,199 | A | 2/1983 | Kushner et al. | |
| 4,429,620 | A | 2/1984 | Burkhardt et al. | |
| 4,483,399 | A | 11/1984 | Colgate | |
| 4,502,308 | A | 3/1985 | Kelly | |
| 4,531,581 | A | 7/1985 | Pringle et al. | |
| 4,580,426 | A | 4/1986 | Zafred | 72/58 |
| 4,588,030 | A | 5/1986 | Blizzard | |
| 4,697,640 | A | 10/1987 | Szarka | |
| 4,848,469 | A | 7/1989 | Baugh et al. | |
| 5,083,608 | A | 1/1992 | Abdrakhmanov et al. | |
| 5,271,472 | A | 12/1993 | Leturno | |
| 5,322,127 | A | 6/1994 | McNair et al. | |
| 5,398,754 | A | 3/1995 | Dinhoble | |
| 5,409,059 | A | 4/1995 | McHardy | |
| 5,409,060 | A | 4/1995 | Carter | |
| 5,435,400 | A | 7/1995 | Smith | |
| 5,472,057 | A | 12/1995 | Winfree | |
| 5,533,573 | A | 7/1996 | Jordan, Jr. et al. | |
| 5,560,426 | A | 10/1996 | Trahan et al. | |
| 5,685,369 | A | 11/1997 | Ellis et al. | |
| 5,901,787 | A | 5/1999 | Boyle | |
| 6,012,516 | A | 1/2000 | Brunet | |
| 6,021,850 | A | 2/2000 | Wood et al. | |
| 6,070,671 | A | 6/2000 | Cumming et al. | |
| 6,098,717 | A | 8/2000 | Bailey et al. | |
| 6,135,208 | A | 10/2000 | Gano et al. | |
| 6,186,233 | B1 | 2/2001 | Brunet | |
| 6,325,148 | B1 | 12/2001 | Trahan et al. | |
| 6,425,444 | B1 | 7/2002 | Metcalfe et al. | |
| 6,446,323 | B1 | 9/2002 | Metcalfe et al. | |
| 6,446,724 | B2 | 9/2002 | Baugh et al. | |
| 6,453,552 | B1 | 9/2002 | Chavez, Jr. et al. | |
| 6,457,532 | B1 | 10/2002 | Simpson | |
| 6,488,095 | B2 | 12/2002 | Buytaert | |
| 6,527,049 | B2 * | 3/2003 | Metcalfe et al. | 166/277 |
| 6,543,552 | B1 | 4/2003 | Metcalfe et al. | |
| 6,578,630 | B2 | 6/2003 | Simpson et al. | |
| 6,702,029 | B2 | 3/2004 | Metcalfe et al. | |
| 6,702,030 | B2 | 3/2004 | Simpson | |
| 6,722,441 | B2 | 4/2004 | Lauritzen et al. | |
| 2004/0055786 | A1 | 3/2004 | Maguire et al. | |
| 2004/0065446 | A1 | 4/2004 | Tran et al. | |

FOREIGN PATENT DOCUMENTS

| | | |
|---|---|---|
| FR | 1 142 975 | 9/1957 |
| FR | 2 471 907 | 11/1995 |
| GB | 1 448 304 | 9/1976 |
| GB | 1 457 843 | 12/1976 |
| GB | 2 216 926 | 10/1989 |
| GB | 2 252 582 | 8/1992 |
| GB | 2 313 860 | 12/1997 |
| GB | 2 320 734 | 7/1998 |
| GB | 2 329 918 | 4/1999 |
| GB | 2 345 308 | 7/2000 |
| RU | 2002035 | 7/1991 |
| RU | 2 064 357 | 7/1996 |
| RU | 2 144 128 | 10/2000 |
| SU | 1745873 | 7/1992 |
| WO | WO 93/24728 | 12/1993 |
| WO | WO 99/18328 | 4/1999 |
| WO | WO 99/23354 | 5/1999 |
| WO | WO 99/35368 | 7/1999 |
| WO | WO 00/37766 | 6/2000 |
| WO | WO 00/37767 | 6/2000 |
| WO | WO 00/37768 | 6/2000 |
| WO | WO 00/37772 | 6/2000 |
| WO | WO 00/37773 | 6/2000 |
| WO | WO 01/18354 | 3/2001 |
| WO | WO 01/38689 | 5/2001 |
| WO | WO 01/60545 | 8/2001 |

* cited by examiner

APPARATUS FOR AND A METHOD OF EXPANDING TUBULARS

The present invention relates to apparatus for and a method of expanding tubulars, and particularly, but not exclusively, to tubulars that include a perforated or slotted portion and a non-perforated portion.

The invention can also be used with combination strings that include non-perforated tubulars and slotted or perforated tubulars that are coupled together to form a string.

Use of the term "tubulars" or "tubular members" herein will be understood to encompass any tubular or tubular member, such as casing, liner, drill pipe etc, and other such downhole tubulars.

It is known to expand tubular members to increase an outer diameter (OD) and/or an inner diameter (ID) of the tubular member. This can be done by radial expansion of the member, where a radial expansion force is applied to a portion of the member to radially expand it. The radial expansion force is typically applied using an inflatable element, such as a packer.

Alternatively, the tubular member can be expanded by applying a radial expansion force to the member so that it undergoes plastic and/or elastic deformation. In this case, the radial expansion force is typically applied using an expander device, e.g. an expansion cone, which is pushed or pulled through the tubular member. An OD of the expander device is typically the same as or slightly less than the final ID of the expanded tubular member.

It will be appreciated that use of the terms "radial expansion" or "radially expanded" herein encompasses both of these options.

The tubular members are typically used to line or case an open borehole, but have other uses as they can be used, for example, to repair damaged portions of casing or liner.

The tubular members can include slotted or perforated portions where the slots or perforations expand into approximate diamond shapes or the like when the tubular member is radially expanded. The slotted or perforated portions can be used, for example, as a sand screen at or near a payzone of a formation or reservoir to prevent sand and other such contaminants from being mixed with hydrocarbons that are recovered from the payzone or reservoir. The slotted or perforated portions can also be used to allow fluids from the payzone or formation to flow into the tubular member so that they can be recovered to the surface. Use of the term "perforated" herein is intended to encompass slots, apertures or the like in the tubular member.

According to a first aspect of the present invention, there is provided apparatus for expanding a tubular member, the apparatus comprising an expander device that is capable of generating different radial expansion forces to expand respective portions of the tubular member.

According to a second aspect of the present invention, there is provided a method of expanding a tubular member, the member including first and second portions, the method comprising the steps of running the tubular member into a borehole and radially expanding the first and second portions in the borehole using an expander device, wherein different radial expansion forces are exerted on the first and second portions respectively.

The tubular member may have separate portions that are radially expandable to different extents. Typically, the respective portions comprise first and second portions. The first portion typically includes at least one perforated portion. The second portion typically includes at least one non-perforated portion. In most preferred embodiments, the perforated portion can expand to a greater extent than the non-perforated portion. Typically, the radial expansion force required to expand the perforated portion is less than the radial expansion force required to expand the non-perforated portion. The tubular member may comprise a string of discrete members having perforated and non-perforated portions. The discrete members are typically coupled together by any conventional means, such as welding, screw threads etc.

"Perforated" as used herein means that the member is provided with one or more apertures, slots or the like. Typically, a plurality of apertures or slots are provided. It will be appreciated that "non-perforated" as used herein means that the member does not have apertures or slots therein.

One embodiment of an expander device comprises an inflatable element having a shaft rotatably attached thereto. The shaft can preferably rotate relative to the inflatable member. A bearing or the like is typically located between the inflatable element and the shaft. The inflatable member typically comprises a packer or the like. At least a portion of the shaft is provided with a screw thread. An expansion cone can be engaged with the screw thread on the shaft. The screw thread on the shaft is typically a low-pitch screw thread, but can be a high-pitch screw thread. The expansion cone is typically capable of longitudinal movement along the screw thread when the shaft is rotated relative to the cone.

The screw thread on the shaft can typically provide a gearing effect to the movement of the cone. A low-pitch screw thread provides for slower movement of the cone relative to the shaft, and can provide relatively high radial expansion forces but slower movement of the cone. A high-pitch screw thread provides for faster movement of the cone relative to the shaft, and can provide relatively lower expansion forces but faster movement of the cone. Thus, the pitch of the screw thread on the shaft can be selected to provide larger or smaller expansion forces as required.

The inflatable element typically acts as an anchor for expansion of the perforated and/or non-perforated portions. Inflation of the inflatable element typically anchors the expander device at a lower end of the non-perforated portion, and can be used to isolate a pulling force that is typically applied to the expanded perforated portion during expansion of the non-perforated portion. The anchoring and isolation provided by the inflatable element substantially prevents the perforations in the pre-expanded perforated portion from collapsing during expansion of the non-perforated portions.

The shaft is typically provided with attachment means (e.g. screw threads and/or a box or pin connection) to facilitate attaching the apparatus to a drill string, coiled tubing string, wireline or the like. The drill string etc. can be used to rotate the shaft relative to the inflatable member. Optionally, the apparatus may include a motor or the like to rotate the shaft. It will be appreciated that a motor will not be required to rotate the shaft where it is coupled directly to a drill string. The motor typically comprises a mud motor where the shaft is coupled to a coiled tubing string.

The shaft can be rotated in the opposite direction relative to the inflatable member to move the cone back down the shaft to its original starting position.

Alternatively, or additionally, the cone is preferably provided with an engagement means that is capable of engaging the screw thread on the shaft. The cone is preferably provided with a release means that is used to release the engagement means from engagement with the screw thread on the shaft. The engagement means may comprise first and second portions that are provided with screw threads. The first and second portions are preferably capable of relative movement towards and/or away from one another. The release means may comprise a threaded rod or bolt that couples the first and second portions together. Rotation of the threaded rod or bolt in a first direction typically brings the first and second portions together, whereas rotation of the rod or bolt in a second direction, typically opposite to the first, separates the two portions. Thus, the cone can be selectively engaged and disengaged from the screw thread provided on the shaft. The cone may include a motor or the like to rotate the threaded rod or bolt to move the portions towards or away from one another.

The movement of the first and second portions can be hydraulically or otherwise controlled. For example, the release means may comprise a hydraulic cylinder that can be used to move the first and second portions towards and/or away from one another.

Alternatively, the cone may be provided with a motor that rotates it in the opposite direction to move the cone to the opposite end of the screw thread (i.e. to return it to its original position).

The release mechanism may comprise other mechanisms e.g. a self-releasing (high angle) or self-holding (small angle) taper such as a Morse Standard Taper Shank or collet-type release.

The expansion cone may be steel or ceramic or a combination of these materials. The cone may also be of tungsten carbide. The cone is typically formed from a material that is harder than the member that it has to expand. It will be appreciated only the portions of the cone that contact that contact the member need be of or coated with the harder material.

The method typically includes the additional steps of providing an expander device comprising an inflatable element having a shaft rotatably attached thereto, wherein at least a portion of the shaft is provided with a screw thread, and an expansion cone that is engaged with the shaft.

The method typically includes the additional steps of attaching the expander device to a drill string, coiled tubing string or the like; and inflating the inflatable element to radially expand a portion of the tubular member into contact with a second conduit. The second conduit may be a casing, liner, a formation around the borehole or the like.

The method typically includes the additional steps of deflating the inflatable member and pulling or pushing the expander device through the tubular member to radially expand at least a portion thereof to increase its outer diameter and/or its inner diameter.

The method typically includes the additional steps of arresting the travel of the expander device when the cone reaches the non-perforated portion (or a relatively in-expansible portion) of the tubular member, inflating the inflatable member and rotating the shaft against the inflatable member. Rotation of the shaft typically causes the cone to move along the screw thread as it is held stationary by contact with an inner surface of the tubular member.

The method typically includes the additional steps of rotating the shaft in the opposite direction to move the cone back along the screw thread. This provides a means of returning the cone to its original starting position.

The method typically includes the additional steps of releasing the engagement means to disengage the cone from the shaft and allowing the cone to travel back down the shaft.

The method typically includes the additional steps of deflating the inflatable member and pulling or pushing the expander device through the tubular member to radially expand at least a portion thereof to increase its outer diameter and/or its inner diameter.

Optionally, the expansion cone may be double-sided. In this embodiment, the expansion cone can be used to radially expand the tubular member in both the upward and downward directions. Use of the terms "upward" and "downward" will be understood to relate to a conventional vertical orientation of a borehole. It will be appreciated that the invention can also be used in deviated wells, and the terms "upward" and "downward" are to be construed accordingly, depending upon the orientation of the well. It will be appreciated that "downward" generally means away from the surface, and "upward" generally means towards the surface. Optionally also, the cone may comprise a plurality of fingers that can be moved from a retracted to an expanded configuration.

A second embodiment of expander device comprises a rotary expansion mechanism and a solid expansion cone located therebelow. The solid expansion cone may be spaced-apart from the rotary expansion mechanism (e.g. by a shaft or the like) or can be integral therewith. The rotary expansion mechanism typically comprises a cage having a plurality of roller bearings attached thereto. The roller bearings are preferably inclined with respect to a longitudinal axis of the mechanism, typically at an angle of around 20°, so that they form an expansion cone on their outer surfaces. Other angles between around 5° and 45° can also be used, although angles outwith this range may also be used. However, the preferred angle is around 20°.

The solid expansion cone is typically of steel or ceramic, but can be a combination of these. The solid expansion cone may also be of tungsten carbide. The cone is typically of a material that is harder than that of the member that is has to expand. It will be appreciated only the portions of the cone that contact that contact the member need be of or coated with the harder material.

The rotary expansion mechanism may be rotated by rotating the drill string. Alternatively, or additionally, the rotary expansion mechanism may be rotated by passing fluid (e.g. drilling mud) over, across or through the expansion mechanism. The roller bearings of the rotary expansion mechanism may be attached to a turbine blade that imparts a rotational force to the roller bearings when fluid passes through, over or across the blade.

The method typically includes the additional steps of rotating the rotary expansion mechanism and pulling or pushing the apparatus through non-perforated portions of the tubular member to impart a radial expansion force thereto. The method typically includes the additional step of pushing or pulling the solid expansion cone through portions of the tubular member that are slotted or perforated.

Optionally, the solid cone can be replaced with a second rotary expansion mechanism.

Embodiments of the present invention shall now be described, by way of example only, with reference to the accompanying drawings, in which.

Figure 1:
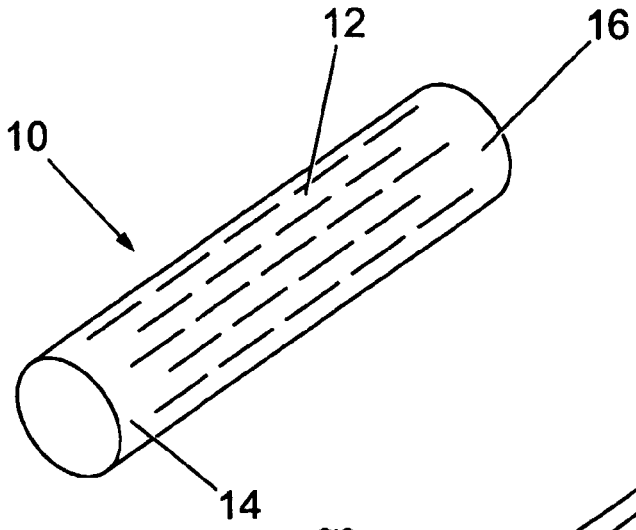
FIG. 1 is a perspective view of a tubular member that includes non-perforated portions and a perforated portion.

Referring to the drawings, FIG. 1 shows a first embodiment of a tubular member 10 (e.g. a portion of casing, liner, drill pipe or other such member) that is used to line or case a borehole (not shown). Use of the term "tubular member" herein will be understood to encompass any tubular member, such as casing, liner, drill pipe etc.

Member 10 is preferably of a ductile material so that it is capable of being plastically and/or elastically deformed to expand an inner diameter (ID) and/or an outer diameter (OD) thereof. Alternatively, or additionally, tubular member 10 may also be capable of radial expansion under the application of a radial expansion force.

Member 10 includes a perforated or slotted portion 12 that is approximately in a central portion of the member 10, and two non-perforated portions 14, 16, one on each side of the perforated portion 12. The non-perforated portions 14, 16 typically house attachment means (e.g. screw threads) that can be used to couple the member 10 into a string of other tubular members. The non-perforated portions 14, 16 provide a strong and reliable coupling between successive tubular members.

The perforated portion 12 is typically used as a sand screen at or near a payzone, a formation or a well. The perforated portion 12 can also be used to facilitate the recovery of hydrocarbons from the payzone, formation or well, as the slots or perforations allow the hydrocarbons to flow into the member 10 so that they can be recovered to the surface (not shown) in a conventional manner.

Figure 2:
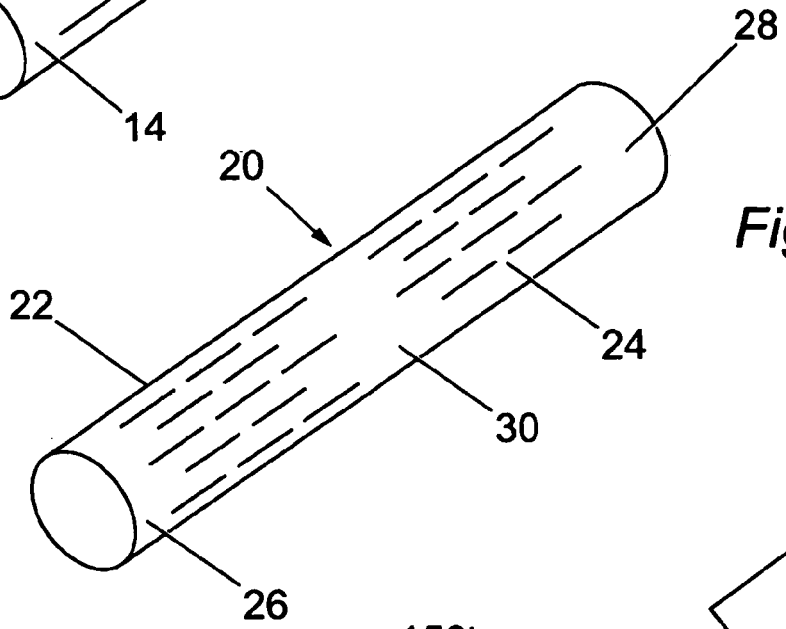
FIG. 2 is a perspective view of an alternative tubular member that includes non-perforated portions and perforated portions.

FIG. 2 shows an alternative tubular member 20 (similar to tubular member 10) that is provided with two axially spaced-apart perforated portions 22, 24, with non-perforated portions 26, 28 at each end, and a further non-perforated portion 30 between the two perforated portions 22, 24.

Tubular members 10, 20 can be used for many different purposes, and are typically used in a string of similar or other tubular members (not shown). The string generally includes a number of tubular members that are non-perforated with one or more of the members 10, 20 or the like that have perforations.

Figure 4:
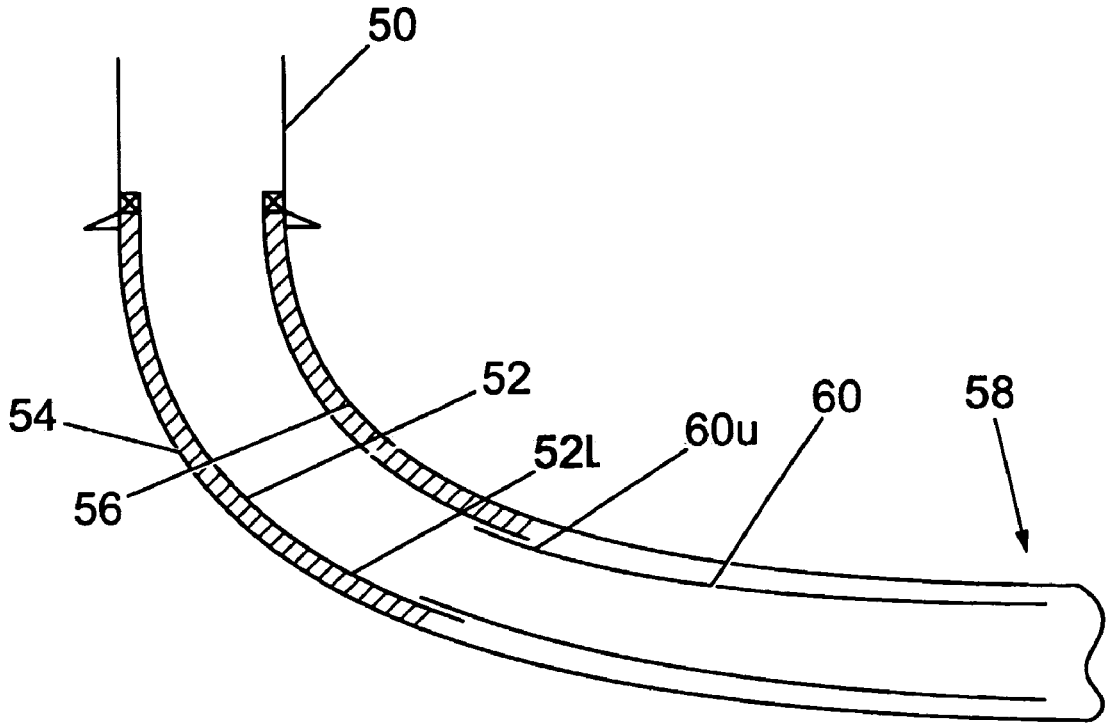
FIG. 4 is a cross-sectional view of a portion of a borehole.

For example and with reference to FIG. 4, there is shown a lower portion of a well or borehole that is provided with a casing 50 at a lower end thereof. A liner 52 (typically one or more non-perforated tubular members) is hung off the bottom of the casing 50 in a conventional manner. The liner 52 is used to line a pre-drilled borehole 56 that extends towards a payzone, formation or well, indicated generally by 58, from which hydrocarbons can be recovered.

The liner 52 is "tied back" to the casing 50 in a conventional manner and can be cemented into place by filling an annulus between the borehole 56 and an outer surface of the liner 52 with cement 54. Thereafter, a perforated member 60 (which could be either member 10 (FIG. 1) or member 20 (FIG. 2) or the like) is inserted through casing 50 and liner 52 so that an upper portion 60u of the member 60 overlaps a lower portion 521 of the liner 52, and the member 60 is then radially expanded, as will be described.

Figure 5:
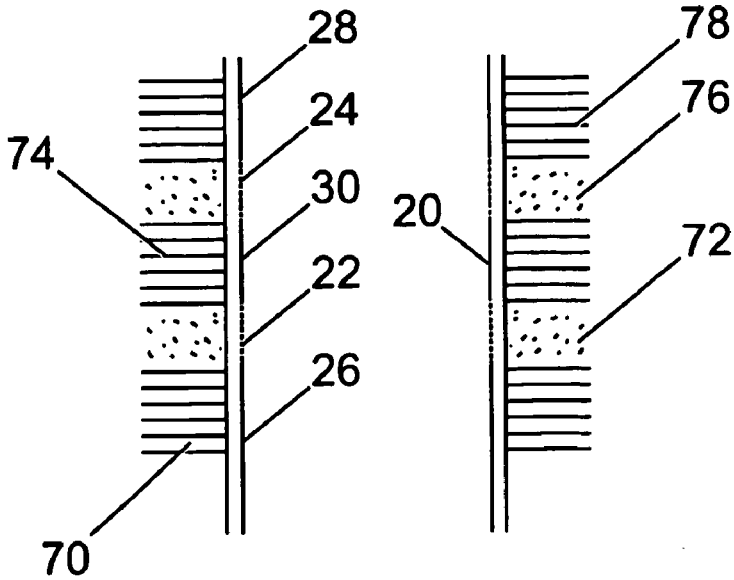
FIG. 5 is a cross-sectional view of a stacked formation.

Referring to FIG. 5, there is shown a cross-sectional view of a portion of a stacked reservoir that typically has layers of different materials that require to be isolated from one another. For example, the stacked reservoir may have a lower shingle or shale layer 70, with a sand or reservoir layer 72 thereabove, a further shingle or shale layer 74 above the sand or reservoir layer 72, and a further sand or reservoir layer 76 below a third shingle or shale layer 78.

The sand or reservoir layers 72, 76 typically facilitate the recovery of hydrocarbons from the surrounding formation that can be recovered to the surface. In the example shown in FIG. 5, tubular member 20 (FIG. 2) can be used to line or case this particular portion of the stacked reservoir. The perforated portions 22, 24 are axially aligned with the sand layers 72, 76. The non-perforated portions 26, 30, 28 are axially aligned with the shale layers 70, 74, 78 respectively, so that they isolate the shale layers 70, 74, 78, whereas the perforated portions 22, 24 act as a sand screen and allow hydrocarbons recovered from the sand or reservoir layers 72, 76 to be recovered to the surface.

Figure 6:
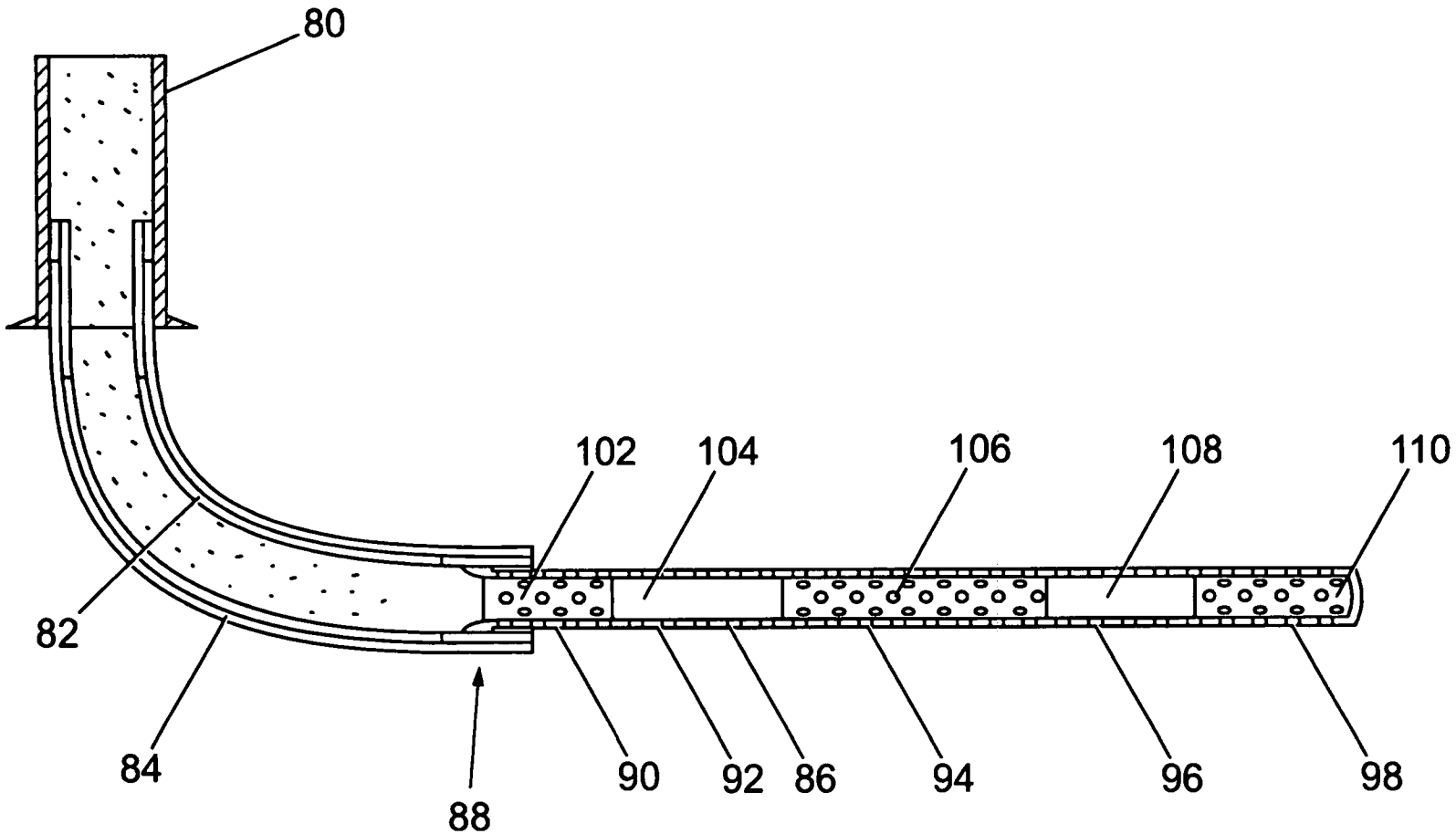
FIG. 6 is a cross-sectional view of a portion of a borehole similar to that of FIG. 4.

FIG. 6 shows a lower portion of a borehole that is similar to that shown in FIG. 4. A casing 80 is provided at a lower end of the borehole that typically forms a string of such casings that prevent the formation surrounding the borehole from collapsing, and also facilitates the recovery of hydrocarbons to the surface. A liner 82 (e.g. one or more non-perforated tubular members) is hung off the bottom of the casing 80 in a conventional manner. The liner 82 is typically cemented into place by filling an annulus between the borehole (not shown) and an outer surface of the liner 82 with cement 84.

A perforated or slotted member 86 (e.g. member 20 (FIG. 2)) is attached at a lower end of the liner 82. The perforated member 86 is tied back to the liner 82 by overlapping the liner 82 and the member 86 so that when the member 86 is radially expanded, an outer surface of the member 86 contacts an inner surface of the liner 82 to create a junction and a seal, generally designated at 88.

As with FIG. 5, a lower end of the horizontal borehole has a number of different portions, similar to the stacked reservoir of FIG. 5 but in a generally horizontal configuration. The borehole of FIG. 6 has a first portion 90 from which hydrocarbons may be recovered; a second portion 92 from which hydrocarbons cannot be recovered (e.g. shale, shingle or the like); a third portion 94 from which hydrocarbons may be recovered; a fourth portion 96 from which hydrocarbons cannot be recovered; and a fifth portion 98 from which hydrocarbons may be recovered.

A combination of non-perforated and perforated tubular members can be used to line the borehole. In this particular example, the combination comprises perforated portions 102, 106, 110 at the (hydrocarbon producing) portions 90, 94, 98 and non-perforated portions 104, 108 at the non-hydrocarbon producing portion 92, 96.

It will be appreciated that the perforated portions 102, 106, 110 of member 86 may comprise tubular members 10 (FIG. 1) that have been coupled to non-perforated tubulars (e.g. lightweight pipe) 104, 108 using screw threads for example. Alternatively, the various portions may comprise a single length with alternate non-perforated and perforated portions, similar to member 20 (FIG. 2).

The hydrocarbon producing portions 90, 94, 98 allow hydrocarbons to flow into the combination of non-perforated and perforated tubular members (i.e. member 86), into the member 86 and thus they can be recovered to the surface.

It will be noted that the members 10, 20, 60, 86 and other combinations of non-perforated and perforated tubular members can be difficult to expand radially because the members include perforated portions and non-perforated portions. The expansion force required to radially expand perforated portions is significantly less than that required to expand non-perforated portions. The higher force exerted on the non-perforated portion can collapse the expanded perforated tubular that is coupled to the non-perforated portion, because the very high force on the non-perforated portion can pull or stretch the perforated portion so that it collapses radially and the perforations close up.

Note that the radial expansion of the members is typically achieved by expanding the member "bottom-up"; that is, the expander device that is used to impart a radial expansion force is pushed or pulled upwardly through the member from the lowest part to be expanded. However, the member can also be expanded top-down, provided that sufficient force can be applied to the expander device by slacking off weight above the device, or hanging off sufficient weight below the expander device.

Figure 3:
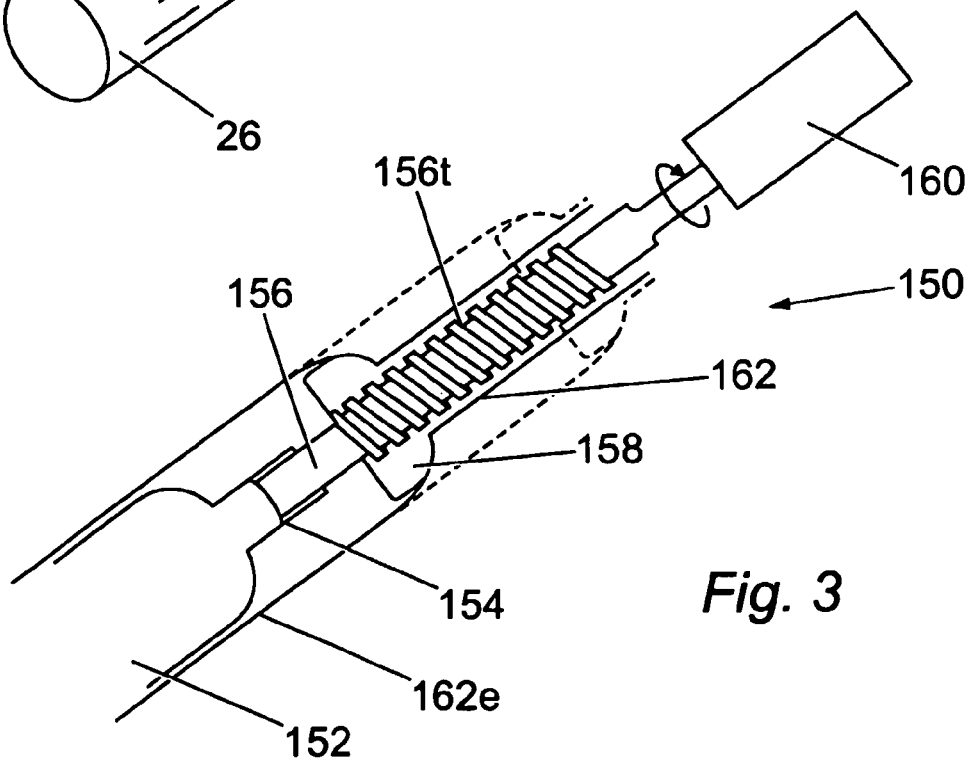
FIG. 3 is part cross-sectional view a portion of a first embodiment of apparatus for expanding tubulars.

FIG. 3 shows a first embodiment of apparatus 150 for expanding tubulars, in this embodiment the tubular is a combination string of perforated and non-perforated tubulars.

Apparatus 150 includes an inflatable element, such as a packer 152 that is located at a lower end of the apparatus 150. A bearing 154, such as a thrust bearing, is located above the packer 152 and has a shaft 156 rotatably attached to it. The bearing 154 allows the shaft 156 to rotate whilst the packer 152 remains stationary. Shaft 156 is part threaded, preferably with a relatively low-pitch screw thread 156*t*, and an expansion cone 158 engages with the screw thread 156*t* on the shaft 156, the cone 158 being capable of longitudinal movement up and down the threaded portion of the shaft 156. A drive means 160 (e.g. a motor or the like) for rotating the shaft 156 is optionally provided at an upper end of the shaft 156. An upper end of the drive means 160 is typically attached to a drill string, coiled tubing string or the like.

It will be appreciated that the drive means 160 may not be required where the shaft 156 is coupled directly to a drill string, as the string can be rotated in a conventional manner to rotate the shaft 156. In this case, the shaft 156 would be provided with attachment means (e.g. screw threads) so that it can be attached to the drill string.

In use, the apparatus 150 is located in a liner 162, casing or the like that is to be radially expanded to increase its outer diameter (OD) and/or inner diameter (ID). The packer 152 and the expansion cone 158 are located in a pre-expanded portion 162*e* of the liner 162 before the liner 162 is run into the borehole to the required depth. The pre-expanded portion 162*e* is typically sufficiently expanded to allow the packer 152 to be located therein, but is generally not fully expanded so that the liner 162 can be run into the borehole.

Once at the required depth, the packer 152 is inflated using any conventional means to expand the pre-expanded portion 162*e* radially outwards so that an outer surface of the pre-expanded portion 162*e* contacts an inner surface of a second conduit. The second conduit may be an uncased formation, pre-installed casing, liner, or the like. The further expansion of the pre-expanded portion 162*e* can act as an anchor for the liner 162 as it is radially expanded by the cone 158.

Optionally, the packer 152 may be deflated and moved within the liner 162, where it is re-inflated to radially expand the liner 162 into contact with the second conduit. The additional expansion of the liner 162 serves to increase the surface area of the outer surface of the liner 162 that acts as an anchor.

The packer 152 is then deflated and the cone 158 is pulled through the liner 162 to radially expand the liner 162 in a known manner. The cone 158 may be pulled through the liner 162 using the drill string, coiled tubing string or the like to which it is attached. When the cone 158 reaches a non-perforated portion of the liner 162, this will be indicated by an increase in the force required to expand the liner 162. At this point, the packer 152 is re-inflated to act as an anchor for the apparatus 150. Thereafter, the shaft 156 is rotated by actuation of the motor 160, or by rotation of the drill string to which shaft 156 is attached. The shaft 156 is thus rotated against the packer 152 using the bearing 154.

It will be appreciated that the packer 152 can be detached from the shaft 156 and left at the lower end of the liner 162 to act as an anchor during expansion of the liner 162. When the cone 158 reaches a non-perforated portion, the cone 158 and shaft 156 are lowered until the packer 152 engages the shaft 156, and the apparatus 150 returned to the non-perforated portion, where the packer 152 is re-inflated.

The cone 158 is located on the low-pitch screw thread 156*t* on the shaft 156 and is prevented from rotating with the shaft 156 by friction on its OD where the cone 158 contacts the liner 162. As the cone 158 is prevented from rotating by contact with the liner 162, it will move up the screw thread on shaft 156 as the shaft 156 rotates, and thus expand the liner 162 over the non-perforated portion.

It will be appreciated that it is preferable to have the length of the portion of the shaft 156 that is provided with the screw thread 156*t* at least as long as the non-perforated portion of the liner 162. It is preferable to have the length of the screw thread 156*t* slightly longer than that required to expand the non-perforated portion. The packer 152 acts as both an anchor for the expansion of the non-perforated portion and can also help prevent the expanded perforated portion therebelow from collapsing by keeping it open against the induced collapsing force.

Once the cone 158 has travelled the length of the screw thread 156*t*, the shaft 156 can be rotated in the opposite direction or the force preventing the cone 158 from rotating is removed, allowing the cone 158 to travel back down the screw thread 156*t* to its original starting position.

The cone 158 can typically be provided with at least a portion of screw thread that interengages with the thread 156*t* on the shaft 156. The thread on the cone 158 could be provided on two or more segments that are capable of being moved towards and away from one another. For example, two portions may be coupled using a threaded shaft (e.g. a bolt) that can be rotated to move the two portions towards and away from one another. One of the portions could be provided with a threaded nut that interengages with the threads on the bolt. The threaded bolt may also be provided with a quick-release mechanism, such as a lever that is moved to disengage the nut from the bolt. This arrangement is similar to that used in a common bench vice.

In use, the bolt may be driven by a motor located within or as part of the cone 158. Rotation of the bolt in a first direction would draw the two portions together and thus the cone 158 would be threadedly engaged with the shaft 156. Rotation of the bolt in a second direction, typically opposite to the first direction, would move the two portions away from one another, thus releasing the cone 158 from the shaft 156 and allowing it to travel back to its original starting position without rotation (e.g. under the force of gravity or as the shaft 156 is pulled out of the borehole).

Alternatively, the two portions may be coupled using a hydraulic cylinder or the like that can be actuated and de-actuated to move the portions towards and away from one another.

As a further alternative, other release mechanisms could be used including a self-releasing (high angle) or self-holding (small angle) taper such as a Morse Standard Taper Shank or collet-type release.

With the cone 158 back in its original position, it can be pulled through the perforated portion until a non-perforated portion is reached, whereupon the packer 152 is then inflated and the shaft 156 rotated to move the cone 158 through the liner to expand it, as previously described.

The cone 158 may be double-sided, that is, the cone 158 can be provided with a face that can be used to expand the liner or the like in both upward and downward directions. Also, two packers 152 could be used, one that travels with the cone 158 as described above, and a second that is used to anchor the liner 162 at a lower end thereof continuously whilst the remainder of the liner 162 is radially expanded, as described above.

It would be advantageous to have a segmented cone that is provided with a plurality of fingers that are capable of being moved from a retracted configuration to an expanded configuration. Outer surfaces of the fingers can provide one or more expansion cones so that when the fingers are in the expanded position, the cone can be used to radially expand the liner 162. However, the cone can be run into the borehole, liner etc in a collapsed state (i.e. with the fingers retracted). This is advantageous as the liner 162 need not be provided with a pre-expanded portion 162*e*, and the apparatus 150 can be run into a liner that has previously been located in the borehole. The fingers of the cone can then be moved to the radially expanded position so that the liner or the like can be expanded.

It will be noted that where an expandable cone is used, the packer 152 can be used to inflate a lower portion of the liner 162 (i.e. at the pre-expanded portion 162*e*) to provide an anchor for the liner 162. Thereafter, the packer 152 is deflated and moved upwardly to a second position, above the first, and inflated again. The second expanded portion of liner 162 facilitates opening of the fingers of the cone more easily into the expanded configuration.

Figure 7:
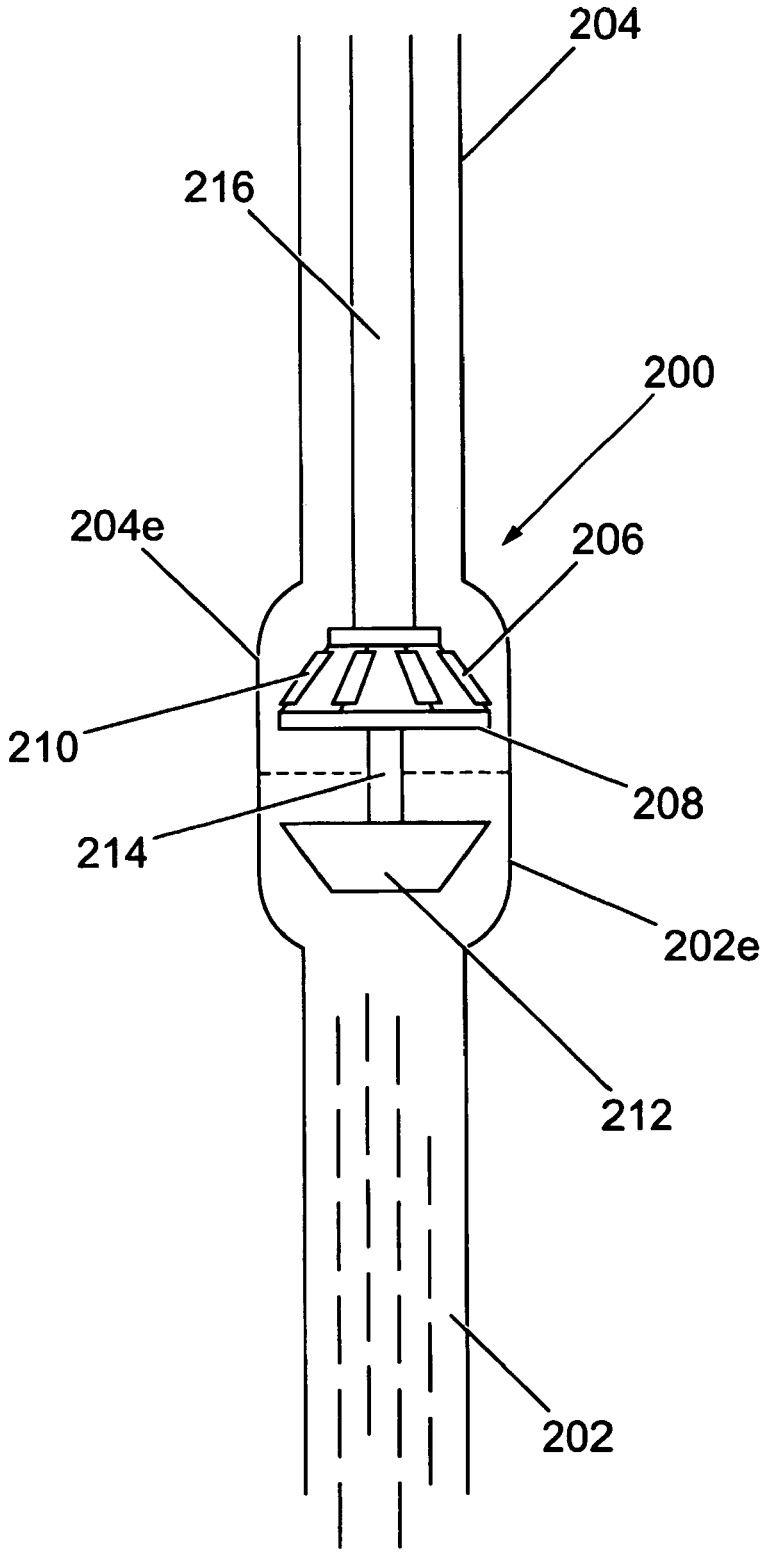
FIG. 7 is a part cross-sectional view of an alternative embodiment of apparatus for expanding tubulars.

Referring to FIG. 7, there is shown an alternative apparatus 200 for the radial expansion of a mixed string of perforated and non-perforated tubulars.

Apparatus 200 is particularly suited for use when expanding portions of non-perforated tubular 202 and perforated or slotted tubular 204. It will be generally appreciated that tubulars 202, 204 may be casing, liner or the like. It will also be appreciated that tubular 202, 204 may comprise a plurality of discrete lengths of tubular member that are coupled together (e.g. by welding or screw threads).

Apparatus 200 includes a rotary expansion mechanism 206 that typically comprises a cage 208 having a number of roller bearings 210 attached thereto. The roller bearings 210 are inclined (typically at around 20° with respect to a longitudinal axis of the apparatus 200) so that they form an expansion cone on their outer surfaces. Other angles between around 5° and 45° can also be used, although angles outwith this range may also be used. However, the preferred angle is around 20°.

The rotary expansion mechanism 206 is primarily used to transmit radial and pull force into a radial expansion force, instead of only pull force. Thus, the rotary expansion mechanism 206 has the advantage of reducing friction.

An upper portion of the rotary expansion mechanism 206 is typically provided with attachment means (not shown) such as screw threads or the like to enable the apparatus 200 to be attached to a drill string, coiled tubing string or the like.

A solid expansion cone 212 is attached below the rotary expansion mechanism 206, typically via a shaft 214 or the like. It will be understood that the solid expansion cone 212 may be integral with the rotary expansion mechanism 206. The solid expansion cone 212 is typically of steel or ceramic, but may be a combination of steel and ceramic, although it may also be made of tungsten carbide or the like. The solid expansion cone 212 is typically of a material that is harder than the member that it has to expand. As before, only the portion of the cone 212 that come into contact with the tubulars 202, 204 need be of or coated with the harder material.

The perforated or slotted tubular 202 is provided with a pre-expanded portion 202*e* in which a portion of the apparatus 200 (typically the solid expansion cone 212) is located. Similarly, the non-perforated tubular 204 is provided with a pre-expanded portion 204*e* that is attached to pre-expanded portion 202*e* in use. Tubulars 202 and 204 can be coupled together using any conventional means, such as screw threads or the like. Conventional pin and box connections may be used, for example.

In use, the slotted or perforated tubular 202 is lowered into the borehole (not shown) to the required depth, and may be held in place using any conventional means (e.g. a packer or the like) if required. Thereafter, the apparatus 200 is attached to a string 216 of drill pipe or the like that forms a conventional drill string. The apparatus 200 is attached to the drill string 216 using any conventional means. It will be appreciated that apparatus 200 could also be attached to a coiled tubing string or the like.

The drill string 216 with the apparatus 200 attached thereto is then lowered into the borehole until the solid expansion cone 212 is located within the pre-expanded portion 202*e* of the perforated or slotted tubular 202. The non-perforated tubular 204 is then lowered into the borehole and the pre-expanded portion 204*e* is threadedly engaged with the pre-expanded portion 202*e* of the perforated or slotted tubular 202.

It will be appreciated that the apparatus 200 can be located in the pre-expanded portions 202*e*, 204*e* and the tubulars 202, 204 threadedly coupled at the surface so that the entire assembly can be lowered into the borehole.

The rotary expansion mechanism 206 is then rotated, typically by rotating the drill string 216. Where the apparatus 200 is coupled to a coiled tubing string, a mud motor or the like (not shown) typically forms part of the string and can be used to rotate the apparatus 200 by actuation of the motor. The rotary expansion mechanism 206 may also be rotated by the flow of drilling fluid (e.g. mud) through, over or across the mechanism 206. For example, the rotary expansion mechanism 206 may be provided with a turbine blade (not shown) that is coupled to the rotary bearings 210 so that drilling fluid that passes over the turbine blades imparts a rotational force to the rotary bearings 210.

As the rotary expansion mechanism 206 is rotated, it is pulled upwards through the non-perforated tubular 204 to radially expand it. The inclination of the roller bearings 210 of the rotary expansion mechanism 206 provides an expansion force that causes a radial plastic deformation of the non-perforated tubular 204 to radially expand its outer diameter and/or its inner diameter. It will be appreciated that use of the term "radial plastic deformation" is understood to be the use of an expander device (e.g. the rotary expansion mechanism 206 or cone 212) that is pushed or pulled through the tubular 204 to impart a radial expansion force to the tubular 204 so that both the ID and the OD of the tubular 204 increases.

Once the non-perforated tubular 204 has been completely expanded, the drill string 216 is then lowered until the solid cone 212 contacts the perforated or slotted tubular 202. The cone 212 is then forced through the perforated or slotted tubular 202 by, for example, slacking off weight above the apparatus 200 so that the weight of the string 216 and the apparatus 200 is used to push down on the cone 212. In this way, the tubular 202 is radially expanded to increase its OD and its ID.

It will be appreciated that the drill string 216 may be rotated, or the apparatus 200 otherwise rotated, so that the cone 212 rotates during use.

After the perforated or slotted tubular 202 has been expanded, the drill string 216 and the apparatus 200 is then removed from the borehole in the conventional manner (e.g. it is pulled out of hole).

It will be appreciated that the solid cone 212 can be replaced with another rotary expansion mechanism 206 that can be used to expand the slotted or perforated tubular 202. Where the combination string comprises a single length of non-perforated tubular above a single length of perforated or slotted tubular, the rotary expansion mechanism 206 can be used for upward expansion of the non-perforated tubular, and a solid cone 212 used for the downward expansion of the perforated or non-perforated tubular. Alternatively, a solid cone (e.g. cone 212) can be used to expand both. For multiple lengths of non-perforated and perforated or slotted tubular, it is preferable to use a rotary expansion mechanism 206 for expansion in both the upward and downward directions.

It is possible that expanding a slotted tubular that has non-perforated portions can be done with the member in compression. The slotted portion can be expanded in this situation and it is possible that the expansion force could increase by a factor of 10 or more at the non-perforated portions without damaging the expanded perforated portion.

Certain embodiments of the apparatus and method allow the radial expansion of a combination string of both perforated or slotted tubulars. Certain embodiments also allow the combination string to be radially expanded in only a single pass of the apparatus through the combination string, thus providing significant savings in terms of costs and rig time.

Modifications and improvements may be made to the foregoing without departing from the scope of the present invention.

The invention claimed is:

1. An apparatus for expanding a tubular member comprising:

an expander device that is capable of generating different radial expansion forces to expand respective portions of the tubular member; and an inflatable element connected to the expander device via a shaft, wherein the shaft is configured to rotate relative to the inflatable element.

2. The apparatus according to claim 1, wherein the expander device includes an expansion cone.

3. The apparatus according to claim 1, wherein the inflatable element comprises a packer.

4. The apparatus according to claim 1, wherein at least a portion of the shaft is provided with a screw thread.

5. The apparatus according to claim 4, wherein the expander device comprises an expansion cone configured to engage the screw thread on the shaft.

6. The apparatus according to claim 5, wherein the screw thread on the shaft is a low-pitch screw thread.

7. The apparatus according to claim 5, wherein the expansion cone is capable of longitudinal movement along the screw thread when the shaft is rotated relative to the cone.

8. The apparatus according to claim 1, wherein the inflatable element acts as an anchor for expansion of perforated and/or non-perforated portions of the tubular member.

9. The apparatus according to claim 1, wherein the inflatable element isolates a pulling force applied to an expanded perforated portion during expansion of a non-perforated portion of the tubular member.

10. The apparatus according to claim 1, wherein the expander device comprises a rotary expansion mechanism and a solid expansion cone attached thereto.

11. The apparatus according to claim 10, wherein the rotary expansion mechanism comprises a cage having a plurality of roller bearings attached thereto.

12. The apparatus according to claim 11, wherein the roller bearings are inclined with respect to a longitudinal axis of the mechanism so that they form an expansion cone on their outer surfaces.

13. The apparatus according to claim 12, wherein the roller bearings are inclined at an angle of around 20°.

14. The apparatus according to claim 10, wherein the rotary expansion mechanism is rotatable.

15. The apparatus according to claim 14, wherein the rotary expansion mechanism is rotatable by rotating a drill string, or by passing fluid over, across or through the expansion mechanism.

16. The apparatus according to claim 1, wherein the respective portions comprise first and second portions.

17. The apparatus according to claim 16, wherein the first portion includes at least one perforated portion, and the second portion includes at least one non-perforated portion.

18. The apparatus according to claim 1, wherein the tubular member comprises a string of discrete members having perforated and non-perforated portions.

19. The apparatus according to claim 1, wherein a bearing is disposed between the shaft and the inflatable element.

20. The apparatus according to claim 19, wherein the bearing is a thrust bearing.

21. A method of expanding a tubular disposed in a borehole, comprising:

expanding a first portion of the tubular with a first expander to enable positioning of a second expander within the first portion after expanding the first portion, the first expander is coupled to the second expander via a shaft, wherein the shaft is configured to rotate relative to the first expander; and expanding a second portion of the tubular adjacent the first portion with the second expander.

22. The method of claim 21, wherein the first and second portions have a substantially uniform diameter prior to expanding.

23. The method of claim 21, further comprising running an apparatus having the first and second expanders into the borehole having the tubular disposed therein.

24. The method of claim 21, wherein the first portion is at an end of the tubular.

25. The method of claim 21, wherein the first expander includes an inflatable element.

26. The method of claim 25, wherein the second expander includes a segmented cone that is moved from a retracted configuration to an expanded configuration upon positioning the second expander within the first portion after expanding the first portion.

27. The method of claim 21, further including isolating the rotation from the first expander.

28. A method of expanding a tubular member in a borehole, the method comprising:

positioning an expansion apparatus in the tubular member, wherein the expansion apparatus includes an expander device coupled to an inflatable element via a shaft;

inflating the inflatable element to radially expand a portion of the tubular member; and rotating the shaft relative to the Inflatable element thereby causing the expansion device to move through the tubular member and radially expand a portion of the tubular, while allowing the inflatable element to remain stationary within the tubular.

29. The method of claim 28, wherein at least a portion of the shaft is provided with a screw thread.

30. The method of claim 29, further comprising attaching the expander device to a drill string or coiled tubing string.

31. The method of claim 30, further comprising deflating the inflatable element and pulling or pushing the expander device through the tubular member to radially expand at least a portion thereof to increase its outer diameter and/or it inner diameter.

32. The method of claim 31, wherein a first portion of the tubular member comprises one or more perforated portions and a second portion of the tubular member comprises one or more non-perforated portions.

33. The method of claim 32, further comprising arresting the travel of the expander device when the device reaches the second portion of the tubular member and inflating the inflatable element and rotating the shaft against the inflatable element.

34. The method of claim 28, further including isolating the rotation from the inflatable element.

35. The method of claim 34, wherein the isolation occurs in a bearing disposed between the shaft and the inflatable element.

36. The method of claim 28, wherein the expander device comprises a rotary expansion mechanism and a solid expansion cone.

37. The method of claim 36, further comprising pushing or pulling the solid expansion cone through the second tubular member.

* * * * *